US005124753A

United States Patent [19]

Asai et al.

[11] Patent Number: 5,124,753

[45] Date of Patent: Jun. 23, 1992

[54] DEVELOPING DEVICE

[75] Inventors: Shingo Asai; Masahiko Adachi; Hiroaki Shinkawa; Yuji Enoguchi, all of Osaka, Japan

[73] Assignee: Minolta Camera Kabushiki Kaisha, Osaka, Japan

[21] Appl. No.: 535,534

[22] Filed: Jun. 11, 1990

[30] Foreign Application Priority Data

Jun. 13, 1989 [JP] Japan ..... 1-151043

[51] Int. Cl.[5] ..... G03G 15/06

[52] U.S. Cl. ..... 355/259; 118/656; 118/661; 355/245

[58] Field of Search ..... 355/259, 260, 245, 251; 118/661, 664, 653, 656; 204/3-6, 9

[56] References Cited

U.S. PATENT DOCUMENTS

| | | | |
|---|---|---|---|
| 4,786,936 | 11/1988 | Ikegawa et al. | 355/300 |
| 4,791,882 | 12/1988 | Enoguchi et al. | 118/653 |
| 4,827,305 | 5/1989 | Enoguchi et al. | 355/259 |
| 4,883,017 | 11/1989 | Yuji et al. | 118/653 |
| 4,907,032 | 3/1990 | Enoguchi et al. | 355/253 |
| 4,920,916 | 5/1990 | Mizuno et al. | 355/259 X |
| 4,974,028 | 11/1990 | Enoguchi et al. | 355/259 |
| 4,987,454 | 1/1991 | Natsuhara et al. | 355/259 |
| 4,990,963 | 2/1991 | Yamamoto et al. | 355/259 |
| 5,008,708 | 4/1991 | Enoguchi et al. | 355/251 X |
| 5,034,300 | 7/1991 | Anno et al. | 118/653 X |
| 5,035,197 | 7/1991 | Enoguchi et al. | 355/245 X |

OTHER PUBLICATIONS

"Xerox Disclosure Journal", vol. 11, No. 5 (Sep./Oct. 1986).

*Primary Examiner*—A. T. Grimley
*Assistant Examiner*—Matthew S. Smith
*Attorney, Agent, or Firm*—Burns, Doane, Swecker & Mathis

[57] ABSTRACT

A developing device having a developing sleeve loosely mounted on the peripheral surface of a cylindrical developing roller. Both end portions of the developing sleeve are pressed against the developing roller by a pair of guide pads so that a part of the developing sleeve keeps contacting the developing roller. The force applied by the the pair of the guide pads to the developing sleeve is in such an extent that driving force of the developing roller is transmitted to the developing sleeve in the portion in which the developing sleeve contacts the developing roller and that the developing sleeve is allowed to rotate in correspondence with the rotation of the developing roller. A blade member for forming a thin layer of toner on the developing sleeve is in contact with the peripheral surface of the developing sleeve. Fine irregularities are formed on the peripheral surface of the developing sleeve so as to hold toners adhered thereto. Compared with a developing sleeve having no irregularities, fine irregularities formed on the inner peripheral surface of the developing sleeve increases frictional force in the portion in which the developing sleeve contacts the developing roller. Fine irregularities are formed on both the peripheral and inner peripheral surface of the developing sleeve by an electroforming using a mother roller having irregularities on the peripheral surface thereof.

7 Claims, 4 Drawing Sheets

DEVELOPING DEVICE

BACKGROUND OF THE INVENTION

1. Field of the Invention

The present invention relates to a developing device for use in an image forming apparatus such as a printer or a copying machine.

2. Description of the Related Art

In this kind of developing device, various types are known. A typical example of known developing devices comprises a developing roller which rotates; a developing sleeve, the circumference of which is longer than that of the developing roller, loosely mounted on the peripheral surface thereof; a pair of guide members for pressing both end portions of the developing sleeve against the developing roller so that the rotational force of the developing roller is transmitted to the developing sleeve; and means for forming a thin layer of a developing toner on the peripheral surface of the developing sleeve.

The developing sleeve of this device has no irregularities on the inner peripheral surface, or smooth even though fine irregularities formed on the outer peripheral surface thereof so as to transport toners efficiently.

SUMMARY OF THE INVENTION

Since the inner peripheral surface of the developing sleeve is smooth, the developing sleeve is apt to slip on the developing roller, with the result that the rotational force of the developing roller is not effectively transmitted to the developing sleeve.

In order to prevent the slippage of the developing sleeve on the developing roller, the guide member may apply a great force to the developing sleeve so that the developing sleeve is pressed against the developing roller. But this method is not preferable because the developing sleeve may be damaged if a great force is applied to the developing sleeve.

The present invention has been made to overcome the disadvantages described above and for its essential object to provide a developing device capable of accomplishing a favorable developing performance by reliably transmitting the rotational force of a developing roller to a developing sleeve and allowing the rotation of the developing sleeve to follow reliably the rotation of the developing roller without a guide member pressing the developing sleeve against the developing roller in a great force.

A developing device in accordance with an embodiment of the present invention comprises a developing roller which is cylindrical and rotated; a developing sleeve having a circumference longer than that of the developing roller and loosely mounted on the peripheral surface of the developing roller; a pair of guide members for pressing both end portions of the developing sleeve against the developing roller so that the driving force of the developing roller is transmitted to the developing sleeve; and means for forming a thin layer of developing toner on the peripheral surface of the developing sleeve. In this construction, the developing sleeve has first fine irregularities formed on the outer peripheral surface thereof for transporting a toner and second fine irregularities formed on the inner peripheral surface thereof.

According to the developing sleeve of an embodiment of the present invention, the developing sleeve is partly pressed against the developing roller by both the guide member and the means for forming a thin layer. In the portion in which the developing sleeve contacts the developing roller, the second fine irregularities are pressed against the peripheral surface of the developing roller. As a result, a great friction is generated in the portion in which the inner peripheral surface of the developing sleeve contact the peripheral surface of the developing roller. Accordingly, the rotation of the developing sleeve reliably follows the rotation of the developing roller. Thus, toners can be transported to a photoreceptor drum in a uniform thickness, thus resulting in a favorable development. Accordingly, it is unnecessary to apply a great force to the developing sleeve by means of the guide member.

The means for forming a thin layer, consisting of a blade member, may be pressed against the peripheral surface of the developing sleeve at a portion in which the developing sleeve comes into contact with the developing roller.

The developing sleeve may be manufactured by an electroforming. The first and second fine irregularities may be formed entirely on the developing sleeve except portions in the vicinities along both ends thereof. A mother roller having irregularities formed on the peripheral surface thereof may be employed in the electroforming.

A developing bias voltage may be applied to the developing sleeve.

BRIEF DESCRIPTION OF THE DRAWINGS

These and other objects and features of the present invention will become apparent from the following description taken in conjunction with the preferred embodiments thereof with reference to the accompanying drawings, in which:

FIG. 9 is an explanatory view explaining the condition of stress generated between an electroforming master and a sleeve formed by an electroforming in which;

DETAILED DESCRIPTION OF THE INVENTION

Figure 1:
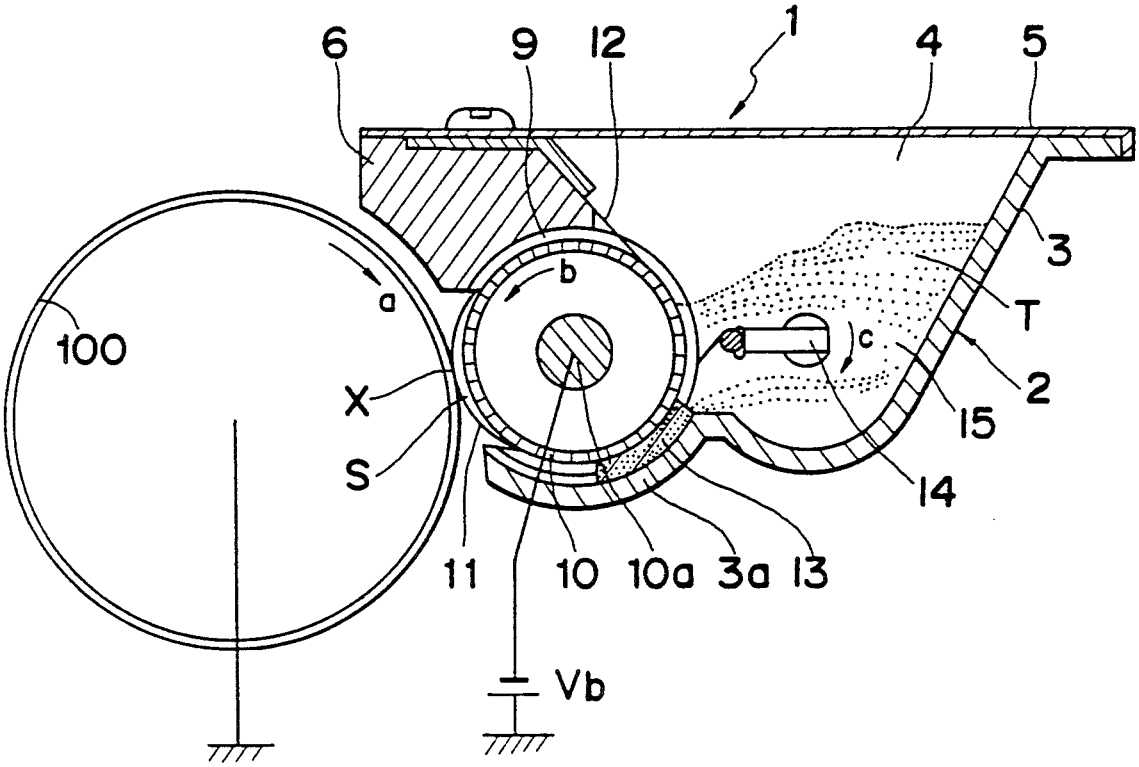
FIG. 1 is a sectional view showing a developing device according to an embodiment of the present invention.

Before the description of the present invention proceeds, it is to be noted that like parts are designated by like reference numerals throughout the accompanying drawings.

A developing device shown in FIG. 1 develops an electrostatic latent image with a one-component developer used in an ordinary copying machine or an ordinary printer.

As shown in FIG. 1, the developing device 1 is placed at a position adjacent to the peripheral surface of a photoreceptor drum 100 which rotates in the direction shown by the arrow (a). The developing device 1 essentially comprises a developer accommodating tank 2 for accommodating a toner (T); a developing roller 10 rotatably supported at one end of the developer accommodating tank 2; and a developing sleeve 11 loosely mounted on the peripheral surface of the developing roller 10.

Supposing that the left side of the developing device 1 shown in FIG. 1 is the front thereof, the developer tank 2 comprises a wall 3 extending from the upper rear portion of the developing sleeve 11 to the lower portion thereof; a front wall 6 disposed in the upper front of the developing sleeve 11; side walls 4 and 4 fixed to the end faces of the wall 3 and the front wall 6, respectively; and a cover 5 mounted on the upper opening formed by the wall 3, the front wall 6, and the side walls 4 and 4.

One end portion of the shaft 10*a* of the developing roller 10, projecting from one of the side walls 4 and 4 of the developer tank 2, is driven by a driving means not shown.

The developer tank 2 accommodating an agitating device 14 is provided rearward of the developing sleeve 11. The agitating device 14 is rotated by a driving means not shown in the direction shown by the arrow (c) of FIG. 1, thus agitating the one-component non-magnetic toner (T) accommodated in the developer tank 2 and supplying the toner (T) to the developing sleeve 11.

The developing roller 10 comprises a conductive member such as aluminum and an elastic member such as rubber covering the conductive member. A developing bias voltage Vb is applied to the developing roller 10.

The circumference of the developing sleeve 11 is a little longer than that of the developing roller 10. Both end portions of the developing sleeve 11 is pressed against the developing roller 10 by guide pads 9 and 9 each positioned between the side wall 4 of the developer tank 2 and the sleeve 11. In order to prevent a toner leakage, a sealing member 13 extending between the side walls 4 and 4 is provided between the sleeve 11 and a wall 3*a*, which is a part of the wall 3, disposed below the sleeve 11. The guide pads 9 and 9 and the sealing member 13 are each composed of an elastic member such as urethane foam.

In the above-described construction, the developing sleeve 11 is pressed against the developing roller 10 by the guide pads 9 and 9. Since the circumference of the developing sleeve 11 is longer than that of the developing roller 10, the front portion of the sleeve 11 loosens. Consequently, a space (S) is formed between the roller 10 and the sleeve 11. The loosened portion contacts the peripheral surface of the photoreceptor drum 100.

In the developing device 1, a blade 12 provided in the upper portion of developer tank 2 comes into contact with the sleeve 11 in a portion in which the developing roller 10 and the sleeve 11 are in contact with each other. The blade 12 serves as a means for forming a thin layer of toner on the sleeve 11.

More specifically, the blade 12 charges the toner (T) supplied to the sleeve 11 and forms a predetermined thin layer of toner on the sleeve 11 while the blade is regulating the amount of toner which adheres to the surface of the sleeve 11.

In the developing device 1, the developing roller 10 is rotated by a driving means (not shown) in the direction shown by the arrow (b) of FIG. 1. The thin layer of toner formed on the sleeve 11 is transported to a developing region (X) in which the toner (T) is supplied to an electrostatic latent image formed on the photoreceptor drum 100 so that the electrostatic latent image is developed.

Figure 2:
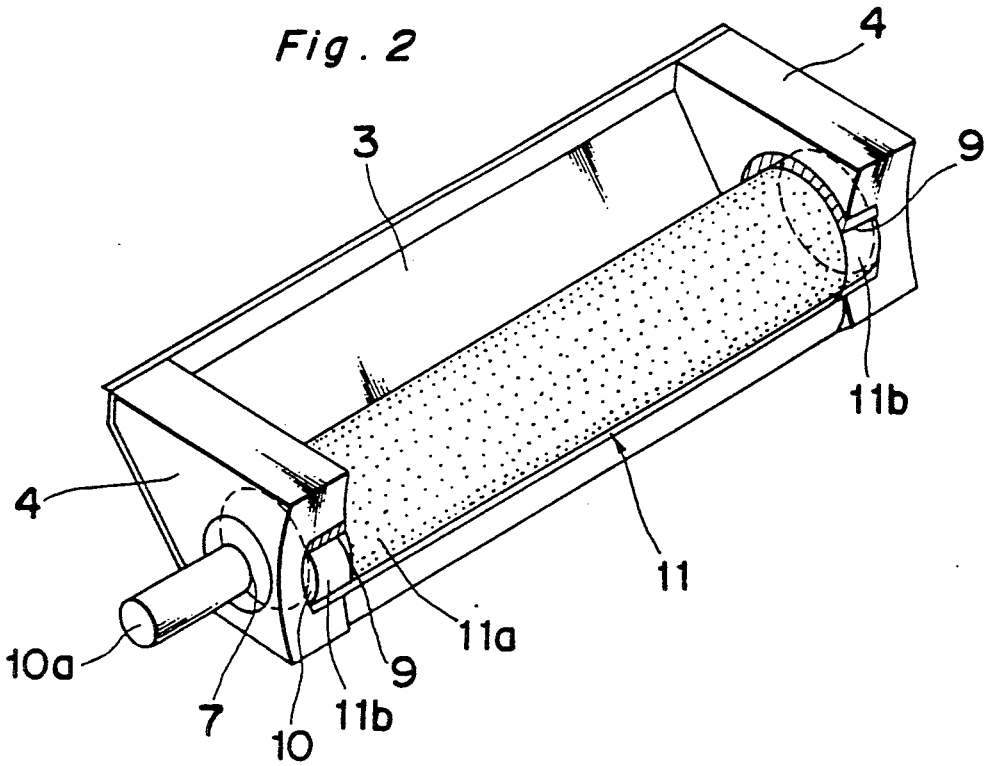
FIG. 2 is a perspective view showing the developer tank, the developing roller, the developing sleeve, and &:he guide member of the developing device of FIG. 1.
Figure 3:
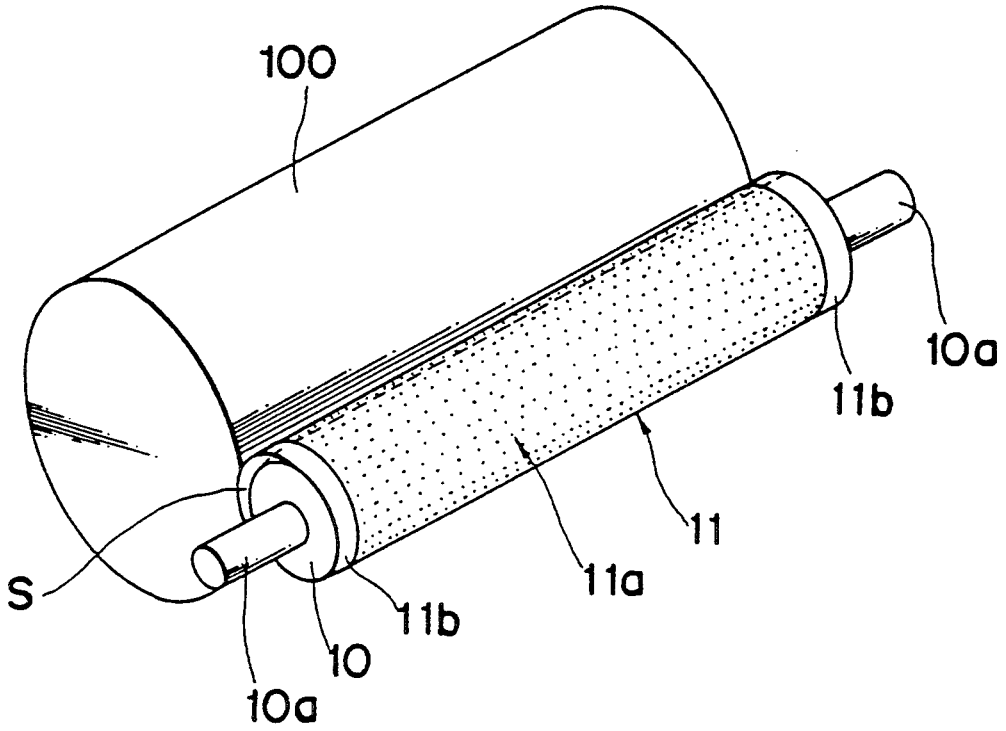
FIG. 3 is a perspective view showing the developing roller, the developing sleeve and a photoreceptor drum of the developing device of FIG. 1.
Figure 4:
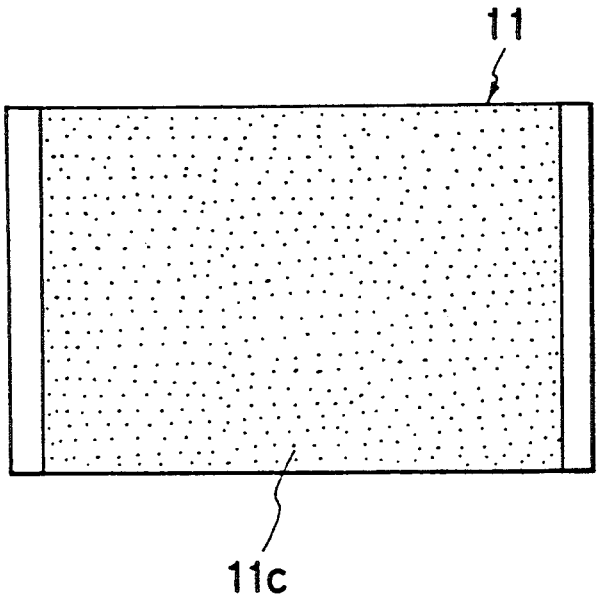
FIG. 4 is a development of the inner surface of a developing sleeve.
Figure 5:
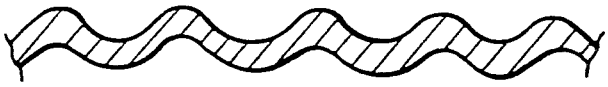
FIG. 5 is a sectional view showing part of the developing sleeve.

The detailed description of the developing sleeve 11 is made below. As shown in FIGS. 2 and 3, fine irregularities are formed on the outer peripheral surface 11*a* of the sleeve 11 so that the toner (T) is smoothly transported to the developing region (X). Referring to FIG. 4 showing a development of the sleeve 11, fine irregularities are also formed entirely on the inner peripheral surface 11*c* of the sleeve 11 except portions in the vicinities along both ends thereof. As shown in FIG. 5 which is a partial sectional view of the fine irregularities, the inner peripheral surface 11*c* of the sleeve 11 is approximately constant in its thickness and forms a zigzag line. As shown in FIG. 4, both surfaces of end portions 11*b* and 11*b* of the sleeve 11 which contact the guide pads 9 and 9, respectively are as smooth as a mirror.

The fine irregularities of the outer peripheral surface 11*a* of the sleeve 11 allows the sleeve 11 to transport the toner (T) smoothly. The fine irregularities of the inner peripheral surface 11*c* of the sleeve 11 reliably transmits the rotation force of the developing roller 10 to the sleeve 11. Accordingly, the sleeve 11 does not slip on the developing roller 10, but reliably rotates in correspondence with the rotation of the developing roller 10, thereby reliably transporting the toner (T) to the developing region (X). Thus, the electrostatic latent image formed on the photoreceptor drum 100 can be favorably developed.

The method for manufacturing the sleeve 11 is selected from injection molding and extrusion molding using a plastic resin or an electroforming. The electroforming is described below.

First, fine irregularities are formed on the peripheral surface of an electroforming master 20 so that the positions of fine irregularities correspond to the toner transporting region. The electroforming master 20 is dipped in an electroforming bath containing a stress reducing agent. As a result, the sleeve 11 having predetermined irregularities deposits on the master 20. The stress reducing agent causes the sleeve 11 which has deposited on the master 20 to generate compressive stress. The sleeve 11 is drawn from the master 20 utilizing the compressive stress. Thus, the sleeve 11 has predetermined fine irregularities formed entirely on the toner transporting region and a mirror-surface portions formed on both end portions which contact the guide pads 9 and 9.

In order to draw the sleeve 11, which has deposited on the master 20, from the master 20 in the atmosphere, the master 20 and the sleeve 11 are dipped in contact with each other in a heat processing liquid so as to heat or cool the sleeve 11 and the master 20 utilizing the difference between the coefficient of thermal expansion of the sleeve 11 and that of the master 20. The air which inflows between the sleeve 11 and master 20 in the drawing under the atmosphere, and the liquid which also inflows between them in the heat processing are called a sleeve drawing medium. The osmotic pressure which makes the sleeve drawing medium penetrate to the boundary between the sleeve 11 and the master 20 contributes to the drawing of the sleeve 11 from of the master 20.

Figure 6:
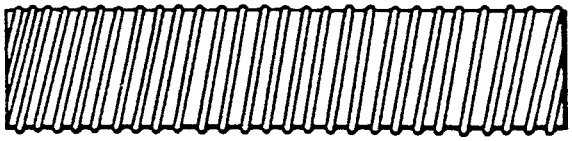
FIG. 6 is an explanatory view showing an example of irregularities formed on the peripheral surface of an electroforming master for use in the manufacture of the developing sleeve shown in FIG. 1.
Figure 7:
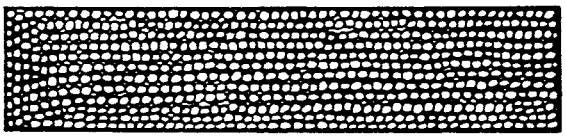
FIG. 7 is an explanatory view showing another example of irregularities formed on the peripheral surface of an electroforming master for use in the manufacture of the developing sleeve shown in FIG. 1.
Figure 8A:
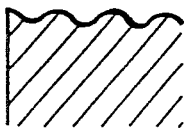
FIG. 8A through 8D are views showing sectional configurations of irregularities formed on the peripheral surface of an electroforming master.
Figure 8B:
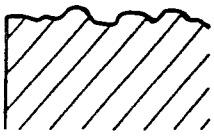
Figure 8C:
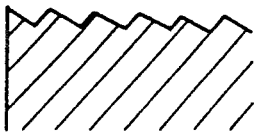
Figure 8D:
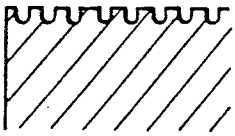

Fine irregularities are continuously formed on the peripheral surface of the master 20 in the circumferential direction thereof by a grinding or a cutting as shown in FIG. 6 or discontinuously formed thereon by a honing, laser beam machining or an etching as shown in FIG. 7.

The roughness degree of the fine irregularity is not limited. Considering that the sleeve 11 is drawn from the master 20 after the electroforming is effected, preferably, the surface roughness Rz which is an average roughness in 10-points of JIS (Japanese Industrial Standard) B 0601 is less than approximately 5 μm although the surface roughness Rz differs more or less depending on a situation.

The composition of the electroforming bath can be appropriately selected depending on the material of the sleeve 11. The material of the sleeve 11 is selected from Al, Ti, Cr, Mo, W, Ni, Ni-Co alloys, Ni-Co-Fe alloys, brass, stainless steel, and the like.

A stress reducing agent is selected from saccharin sodium, sodium naphthalenedisulfonate, p-toluensulufonamide, sodium benzenedisulfonate, and the like.

Figure 9A:
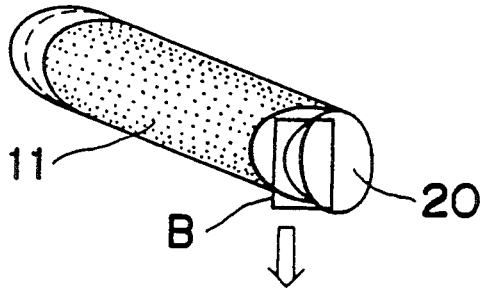
FIG. 9A is a perspective view showing the master and the sleeve.
Figure 9B:
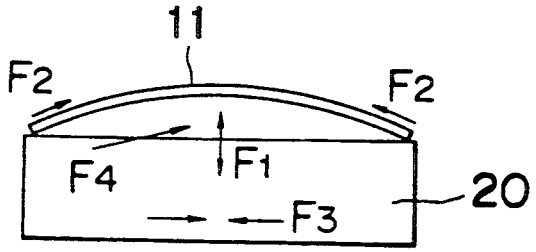
FIG. 9B is an enlarged explanatory view showing (B) portion of FIG. 9A.

FIG. 9A is a perspective view showing the sleeve 11 which deposits on the peripheral surface of the master 20 during an electroforming. FIG. 9B shows the stress which is generated between the sleeve 11 and the master 20 during the electroforming. Referring to FIG. 9B, $F_1$ denotes adhesion force generated therebetween. $F_2$ denotes the internal stress (compressive force) of the sleeve 11. $F_3$ denotes force generated, at the boundary therebetween, by the difference in the coefficients of both thermal expansions or the difference in the coefficients of both thermal contractions. $F_4$ denotes the osmotic pressure generated by the sleeve drawing medium. It is necessary that the sleeve 11 does not separate from the master 20 or a wrinkle is not formed on the sleeve 11. To this end, the following inequality must be satisfied.

$F_1 >$ vertical component force of $F_2$ inequality (1)

The following inequality must be satisfied so that the sleeve 11 is drawn from the master 20:

$F_1 <$ vertical component force of $F_2$ + vertical component force of $F_3$ + vertical component force of $F_4$ inequality(b 2)

The stress reducing agent and the amount thereof contained in the electroforming bath are required to cause the sleeve 11 to generate compressive stress which satisfies the inequalities (1) and (2). Although compressive force varies to some extent depending on conditions, it is necessary that compressive stress is more than 3 kgf/mm$^2$ according to a measurement using a spiral stress meter supposing that the sleeve 11 is formed for use in an ordinary image forming apparatus.

The material of the master 20 is selected from (1) austenitic stainless steel, ferritic stainless steel, (2) chrome-plated or nickel-plated iron, (3) nickel and titan, (4) chrome-plated or nickel-plated aluminum and brass. The adhesion force between the sleeve 11 and the master 20 differs from each other depending on the material of the master 20. Austenitic stainless steel is most favorable for drawing the sleeve 11 from the master 20.

It is necessary that force is effectively generated based on the difference between the thermal expansion coefficient or thermal contraction coefficient of the sleeve 11 and that of the master 20 when both are heated or cooled to draw the sleeve 11 from the master 20. To this end, preferably, the master 20 is hollow so that it does not have a great thermal capacity.

The detailed description of the method for manufacturing the sleeve 11 is made below.

According to the embodiment, the material of the sleeve 11 is nickel. The thickness, outer diameter, length, width of the mirror-surface portion of the sleeve 11 are 35 μm, 25 mm, 250 mm, and 12 mm, respectively.

A hollow pipe, sectionally circular, consisting of austenitic stainless steel (SUS304) is prepared as the master 20. Portions corresponding to the mirror-surface portion 11*b* positioned in both end portions of the hollow pipe are each masked with an adhesive tape. Next, the peripheral surface of the hollow pipe is honed with glass beads so as to form fine irregularities. Thus, the master 20 to be subjected to an electroforming treatment is prepared. The roughness Rz of the fine irregularity is approximately 2 μm. The master 20 is dipped in an electroforming bath with the master 20 supported by an appropriate supporting member and rotated in the electroforming bath so that the sleeve 11 deposits on the master 20.

The electroforming bath is a solution containing 220~450/l of nickel sulfaminate, 40~60/l of $H_3BO_3$, and a stress reducing agent (saccharine sodium). The pH of the solution ranges from 4.0 to 4.7 and the temperature thereof is approximately 50° C.

Figure 10:
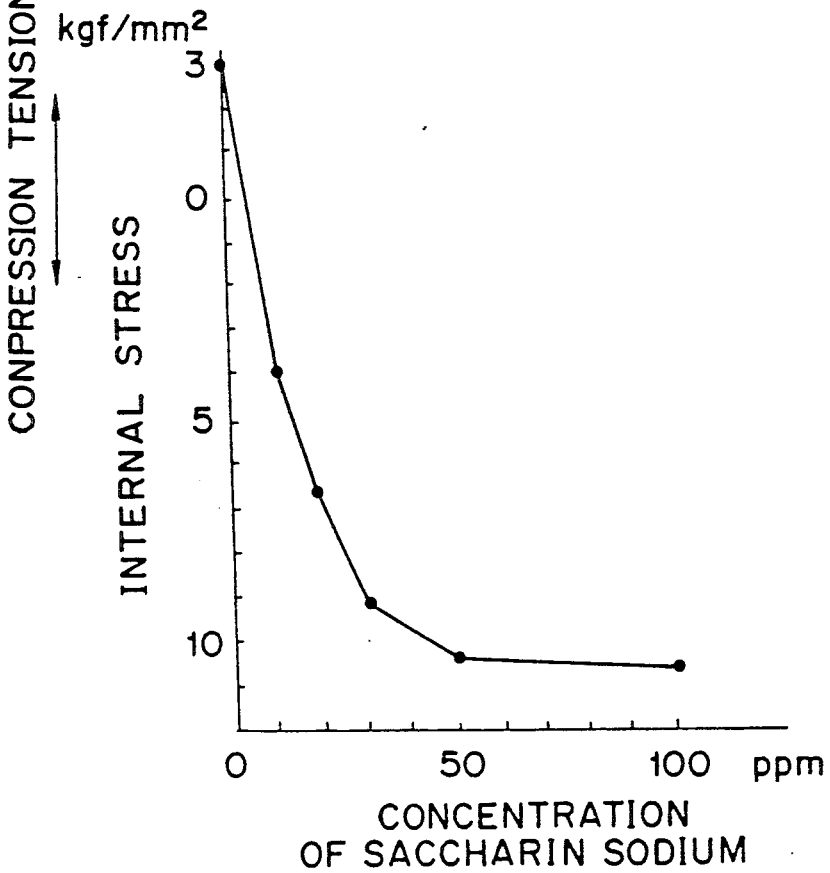
FIG. 10 is a graph showing the relationship between the amount of saccharin sodium added to an electroforming bath and the internal stress of a sleeve which has deposited on an electroforming master.

The relationship between the internal stress of the sleeve 11 and saccharin sodium is as shown in FIG. 10. In order to satisfy the inequalities (1) and (2), saccharin sodium is added to the solution in the concentration of more than 10 p.p.m. so that the sleeve 11 which has deposited on the master 20 generates compressive stress greater than approximately 3 kgf/mm$^2$ measured by a spiral stress meter.

Experiments were conducted to compare the drawing performance of the sleeve 11 on the case in which the internal stress of the sleeve 11 is compressive stress smaller than 3 kgf/mm$^2$, 0 kgf/mm$^2$, and a negative internal stress, namely, tensile stress. The sleeve 11 was not drawn from the master 20 in the above three cases.

The sleeve 11 which has deposited on the master 20 is dipped in water containing a sleeve drawing medium of approximately 28° C. so as to cool the sleeve 11 and the master 20. The inner diameter of the sleeve 11 becomes greater than the outer diameter of the master 20 by 10~20 μm owing to the action of the compressive stress caused by the stress reducing agent. Therefore, the sleeve 11 can be drawn from the master 20. Thus, the developing sleeve 11 having fine irregularities formed on only the toner transporting region is obtained.

The developing sleeve 11 has fine irregularities on the inner peripheral surface 11*c* as well in correspondence with those formed on the outer peripheral surface. The fine irregularities formed on the inner peripheral surface 11*c* is effective for transmitting the rotational force of the developing roller 10 to the sleeve 11. Further, since the mirror-surfaces 11*b* and 11*b* are formed in both end portions of the sleeve 11, the guide pads 9 and 9 can be pressed against the developing sleeve 11 in a smooth contact therewith.

For a comparison, instead of austenitic stainless steel, sleeve drawing performance tests were conducted using the master 20 made of ferritic stainless steel (SUS 430), ball-bearing steel (SUJ), chrome-plated brass, and nickel-plated brass as the material of the master 20. The experiment revealed that the sleeve 11 made of SUS 430 and SUJ were not drawn from the master 20 and the sleeve 11 was hard to be drawn from the master 20 made of the other two materials.

As shown in FIGS. 8A through 8D, the fine irregularity of the master 20 is formed in an arbitrary configuration. For example, when fine irregularities are formed by honing, the configuration of the fine irregularity is selected depending on the particle diameter, particle diameter distribution, material, configuration of honing beads, and a honing pressure, and process time.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A developing device comprising:

a developing roller which is cylindrical and rotated;

a developing sleeve having a circumference longer than that of said developing roller and loosely mounted on the peripheral surface of said developing roller;

said developing sleeve having first preformed irregularities formed on the outer periphery surface thereof for transporting a toner and second preformed irregularities on the inner peripheral surface thereof;

a pair of guide members for pressing both end portions of said developing sleeve against said developing roller so that the driving force of said developing roller is transmitted to said developing sleeve; and means for forming a thin layer of developing toner on the outer peripheral surface of said developing sleeve.

2. A developing device as claimed in claim 1, wherein said means for forming a thin layer is pressed against the outer peripheral surface of said developing sleeve in the portion in which said developing sleeve contacts said developing roller.

3. A developing device as claimed in claim 2, wherein said means for forming a thin layer consists of a blade member.

4. A developing device as claimed in claim 1, wherein said means developing sleeve is manufactured by an electroforming.

5. A developing device as claimed in claim 1, wherein a developing bias voltage is applied to said developing roller.

6. A developing device as claimed in claim 1, wherein said developing sleeve is manufactured by an electroforming using a mother roller having irregularities formed on the peripheral surface thereof.

7. A developing device comprising:

a developing roller which is cylindrical and rotated;

a developing sleeve having a circumference longer than that of said developing roller and loosely mounted on the peripheral surface of said developing roller;

said developing sleeve having first fine irregularities formed on the outer periphery surface thereof for transporting toner and second fine irregularities on the inner peripheral surface thereof, wherein said first and second fine irregularities are formed in the middle portion of said developing sleeve except for portions along both ends thereof;

a pair of guide members for pressing both end portions of said developing sleeve against said developing roller so that the driving force of said developing roller is transmitted to said developing sleeve; and means for forming a thin layer of developing toner on the outer peripheral surface of said developing sleeve.

* * * * *